US012662780B2

(12) United States Patent
Sheehan

(10) Patent No.: US 12,662,780 B2
(45) Date of Patent: Jun. 23, 2026

(54) ROLLING LEVERER FOR SAND BED FOR STONE PAVERS

(71) Applicant: Finbarr Sheehan, Mississauga (CA)

(72) Inventor: Finbarr Sheehan, Mississauga (CA)

( * ) Notice: Subject to any disclaimer, the term of this patent is extended or adjusted under 35 U.S.C. 154(b) by 739 days.

(21) Appl. No.: 18/109,355

(22) Filed: Feb. 14, 2023

(65) Prior Publication Data

US 2024/0271373 A1 Aug. 15, 2024

(51) Int. Cl.
*E01C 19/20* (2006.01)

(52) U.S. Cl.
CPC .... *E01C 19/2005* (2013.01); *E01C 2019/206* (2013.01)

(58) Field of Classification Search
CPC ..... E01C 19/2005; E01C 2019/206
USPC ..... 404/101, 119
See application file for complete search history.

(56) References Cited

U.S. PATENT DOCUMENTS 413,846 A * 10/1889 Chambers ..... E01C 19/42 404/119
985,214 A * 2/1911 Shroyer ..... E01C 19/42 404/119
1,838,635 A 12/1931 Carl
1,909,458 A * 5/1933 Dieckmann ..... E01C 19/502 404/106
4,115,976 A * 9/1978 Rohrer ..... E04F 21/04 52/741.1
4,437,828 A * 3/1984 Egger ..... E04G 21/10 248/188.4
5,468,095 A * 11/1995 Dawson ..... B28B 1/29 404/118
5,980,154 A 11/1999 Record
6,223,495 B1 * 5/2001 Shaw ..... E04F 21/04 52/DIG. 1
6,488,442 B2 12/2002 Boudreaux, Sr.
D483,632 S 12/2003 Masseria
6,866,445 B2 * 3/2005 Semler ..... E04F 21/04 52/678
7,192,216 B2 3/2007 Casale
8,622,649 B1 * 1/2014 Peeroo ..... E01C 19/15 404/119
8,678,702 B1 * 3/2014 De Jong ..... E01C 19/15 404/85
2004/0028473 A1 * 2/2004 Craghan ..... E04F 21/05 404/119
2009/0252554 A1 10/2009 Lura

FOREIGN PATENT DOCUMENTS

WO 2002041732 5/2002

* cited by examiner

*Primary Examiner* — Raymond W Addie

(57) ABSTRACT

The rolling leveler for sand bed for stone pavers is configured for use with sand. The rolling leveler for sand bed for stone pavers levels sand after the sand has been placed into a sand mold structure. The rolling leveler for sand bed for stone pavers comprises a screed structure and a rail structure. The screed structure rolls along rail structure. The rail structure elevates the screed structure above the sand contained in the sand mold structure. The elevation of the screed structure above the sand mold structure is adjustable. The screed structure rolls along the rail structure to level the sand contained in the sand mold structure.

11 Claims, 6 Drawing Sheets

ROLLING LEVERER FOR SAND BED FOR STONE PAVERS

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of molds with adjustable parts configured for use with cementitious materials. (B28B7/02)

SUMMARY OF INVENTION

The rolling leveler for sand bed for stone pavers levels sand after the sand has been poured into a mold structure. The rolling leveler for sand bed for stone pavers comprises a screed structure and a rail structure. The screed structure rolls along rail structure. The rail structure elevates the screed structure above the sand contained in the mold structure. The elevation of the screed structure above the mold structure is adjustable. The screed structure rolls along the rail structure to level the sand contained in the mold structure.

These together with additional objects, features and advantages of the rolling leveler for sand bed for stone pavers will be readily apparent to those of ordinary skill in the art upon reading the following detailed description of the presently preferred, but nonetheless illustrative, embodiments when taken in conjunction with the accompanying drawings.

In this respect, before explaining the current embodiments of the rolling leveler for sand bed for stone pavers in detail, it is to be understood that the rolling leveler for sand bed for stone pavers is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the rolling leveler for sand bed for stone pavers.

It is therefore important that the claims be regarded as including such equivalent construction insofar as they do not depart from the spirit and scope of the rolling leveler for sand bed for stone pavers. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
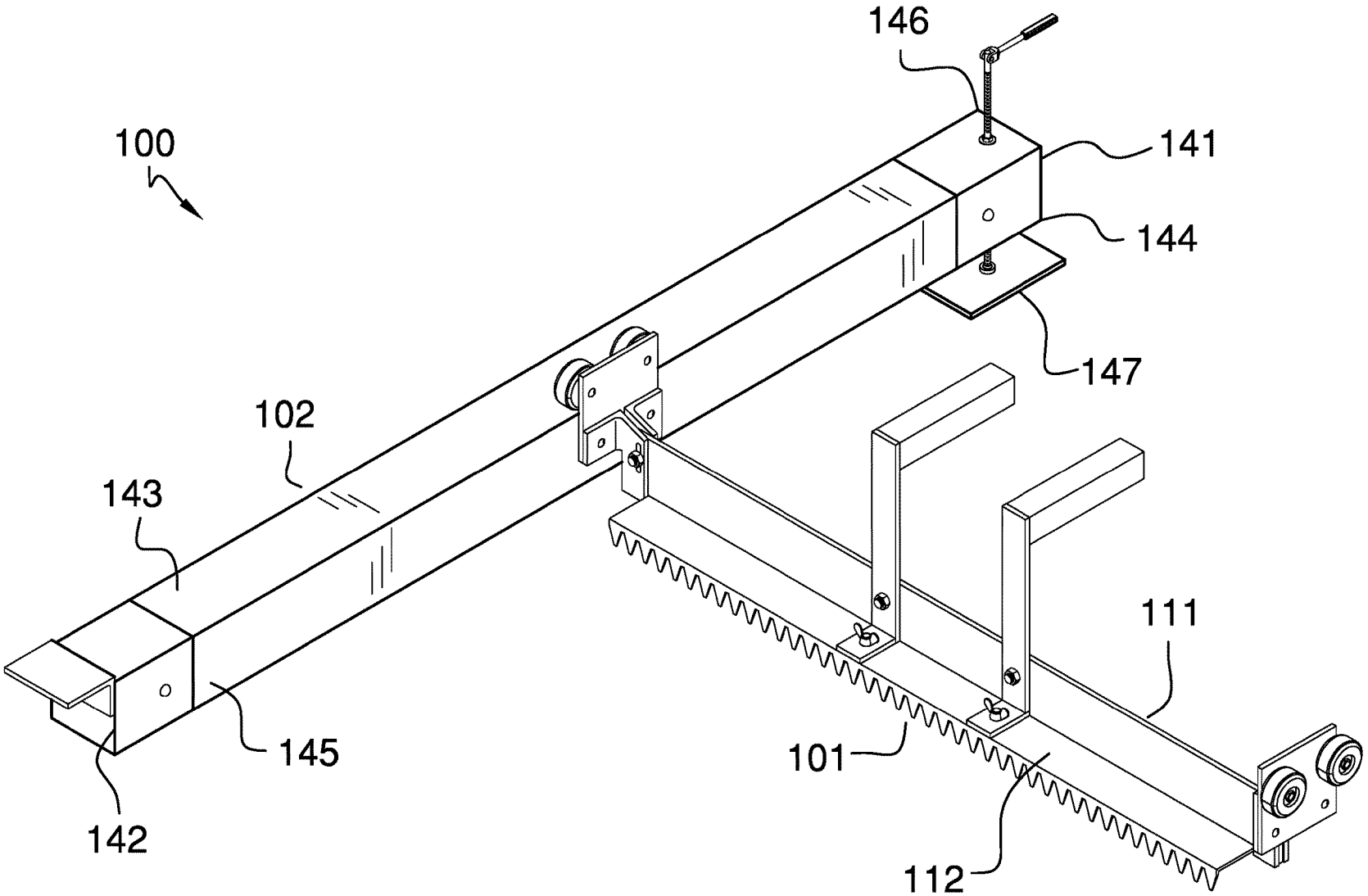
FIG. 1 is a perspective view of an embodiment of the disclosure.
Figure 2:
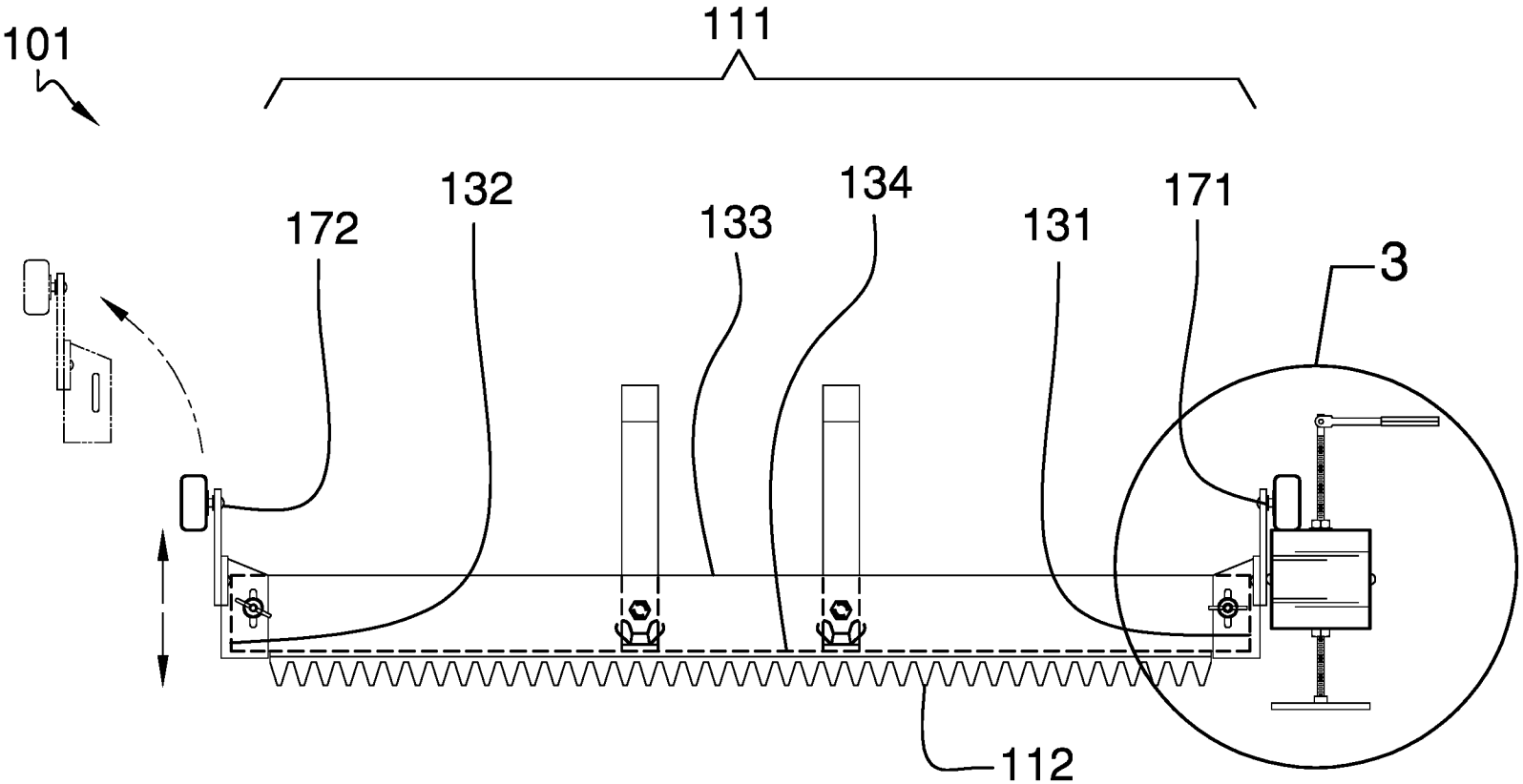
FIG. 2 is a front view of an embodiment of the disclosure.
Figure 3:
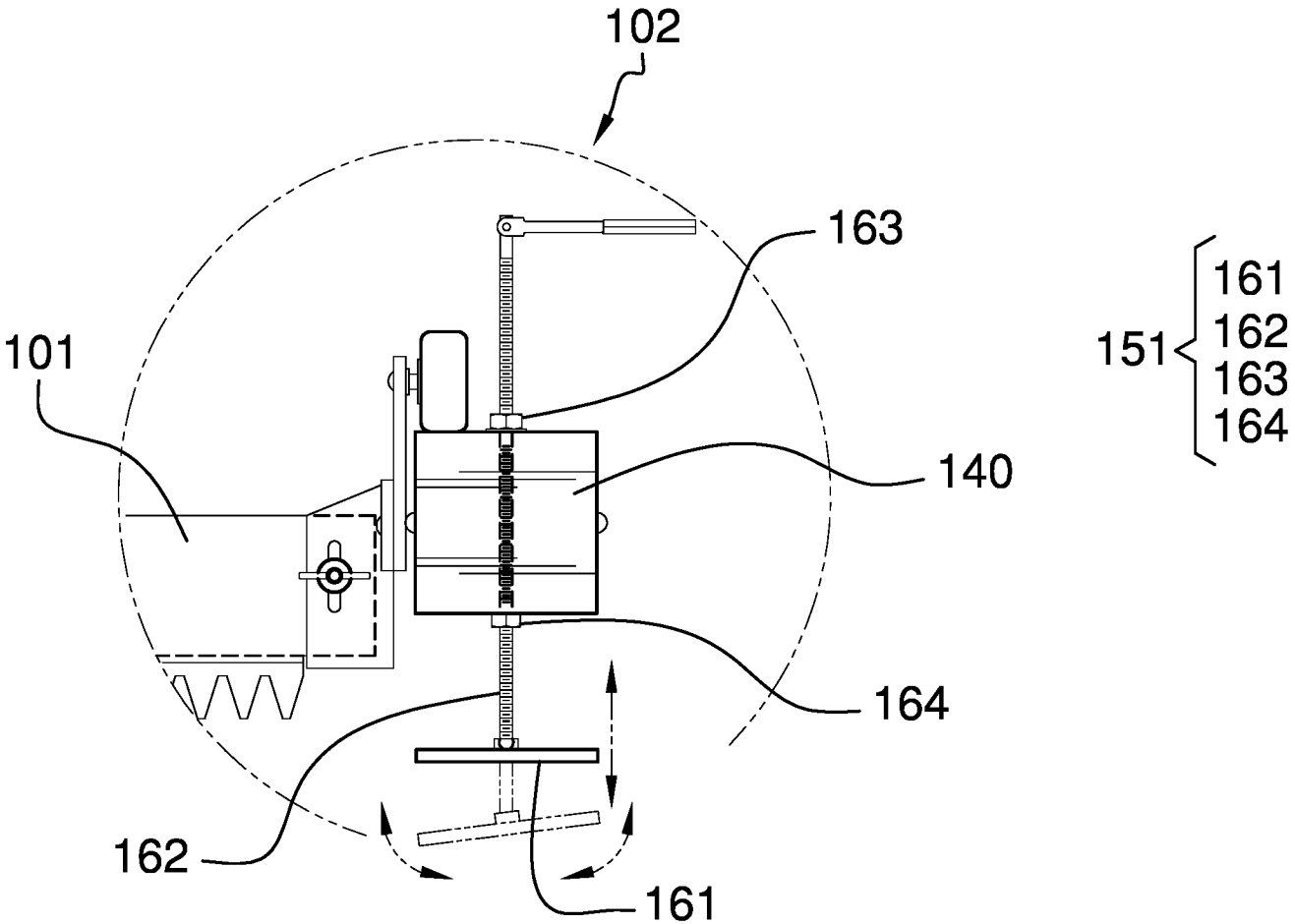
FIG. 3 is a side view of an embodiment of the disclosure.
Figure 4:
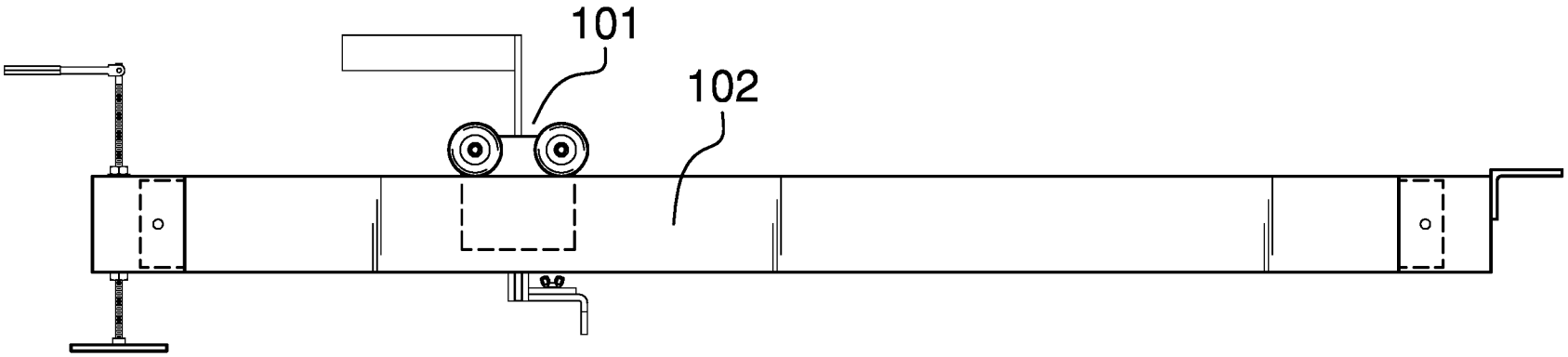
FIG. 4 is a detail view of an embodiment of the disclosure.
Figure 5:
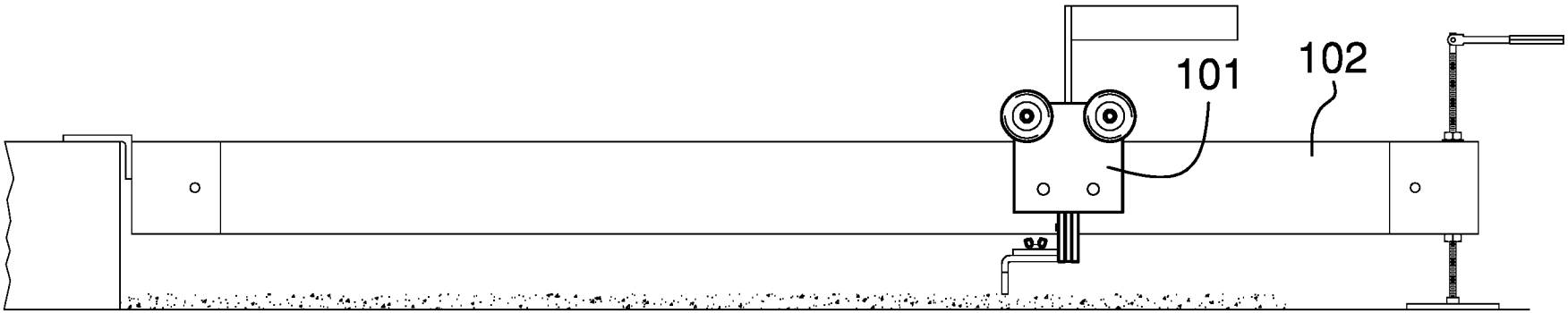
FIG. 5 is a detail view of an embodiment of the disclosure.
Figure 6:
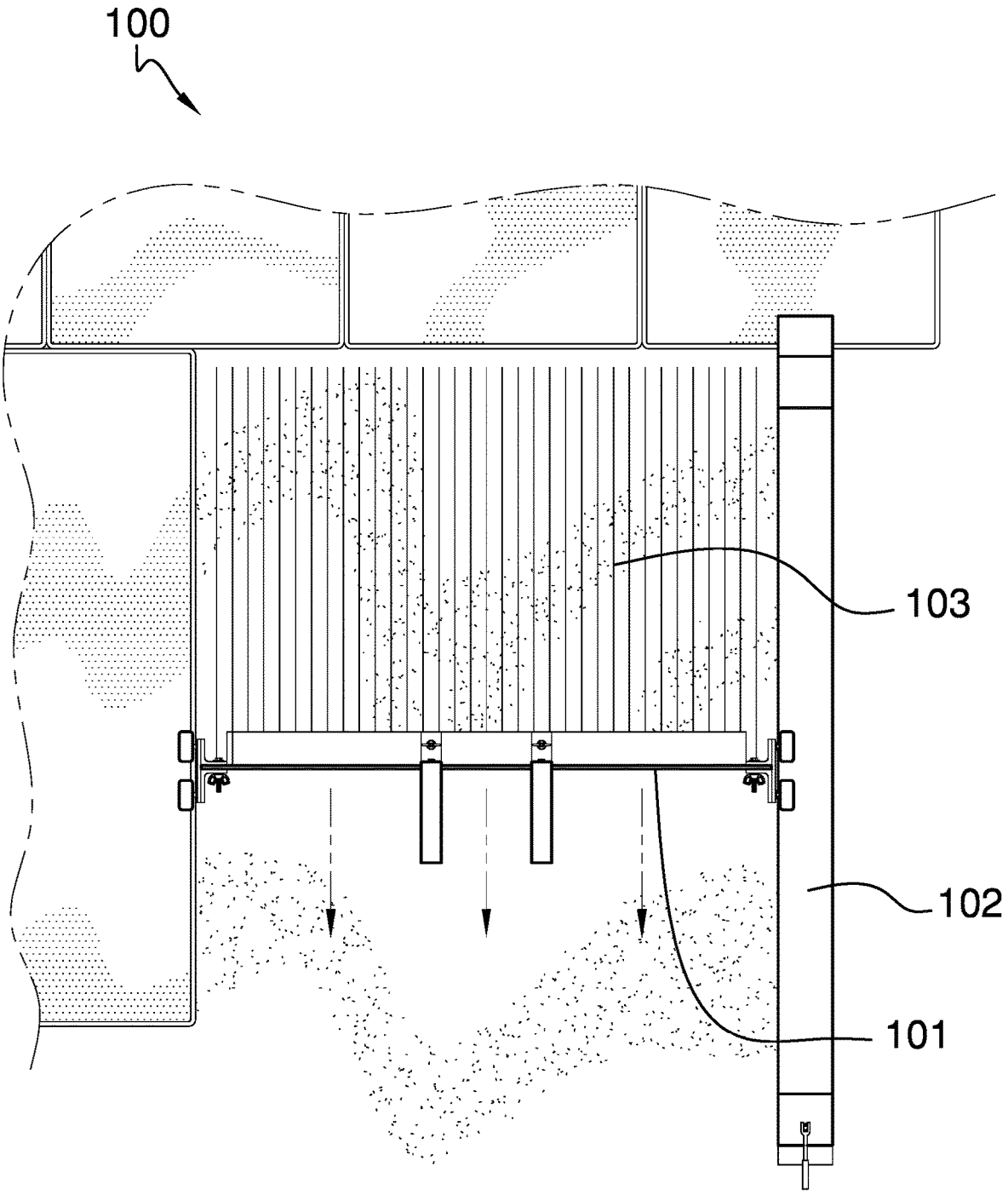
FIG. 6 is an in-use view of an embodiment of the disclosure.

Detailed reference will now be made to one or more potential embodiments of the disclosure, which are illustrated in FIGS. 1 through 6.

The rolling leveler for sand bed for stone pavers 100 (hereinafter invention) is configured for use with sand. The invention 100 levels sand after the sand has been poured into a sand mold structure 103. The invention 100 comprises a screed structure 101 and a plurality of rail tracks 102. The screed structure 101 rolls along plurality of rail tracks 102. The plurality of rail tracks 102 elevates the screed structure 101 above the sand contained in the sand mold structure 103. The elevation of the screed structure 101 above the sand mold structure 103 is adjustable. The screed structure 101 rolls along the plurality of rail tracks 102 to level the sand contained in the sand mold structure 103. The sand mold structure 103 forms a mold that receives sand.

The screed structure 101 is the component of the invention 100 that levels the sand contained in the sand mold structure 103. The screed structure 101 attaches to the plurality of rail tracks 102. The plurality of rail tracks 102 elevates the screed structure 101 above the sand contained in the sand mold structure 103. The elevation of the screed structure 101 is adjustable. The elevation of the screed structure 101 is adjusted by adjusting the plurality of rail tracks 102.

The elevation of the plurality of rail tracks 102 elevates the screed structure 101 such that the screed structure 101 straddles the sand contained in the sand mold structure 103. The screed structure 101 is a rolling structure. The screed structure 101 rolls along a track formed by the plurality of rail tracks 102. The elevation of the screed structure 101 is set such that the screed structure 101 levels the sand contained in the sand mold structure 103 as the screed structure 101 rolls along the track formed by the plurality of rail tracks 102.

The screed structure 101 comprises a screed bar 111 and a rake 112.

The screed bar 111 is a rigid structure. The screed bar 111 attaches to the plurality of rail tracks 102 such that the screed bar 111 moves relative to the plurality of rail tracks 102. The screed bar 111 is a rolling structure. The screed bar 111 rolls along a track formed by the plurality of rail tracks 102. The screed bar 111 straddles the sand contained in the sand mold structure 103. The plurality of rail tracks 102 adjusts the elevation of the screed bar 111 relative to the sand mold structure 103 such that the sand contained in the sand mold structure 103 is leveled to the desired elevation.

The screed bar 111 straddles the sand contained in the sand mold structure 103. The screed bar 111 secures the rake 112 to the plurality of rail tracks 102. The screed bar 111 removes the excess sand from the sand contained in the sand mold structure 103.

The screed bar 111 comprises a first screed congruent end 131, a second screed congruent end 132, a screed superior lateral face 133, and a screed inferior lateral face 134.

The first screed congruent end 131 is a congruent end of the prism structure of the screed bar 111. The face formed by the first screed congruent end 131 is aligned to be parallel to the force of gravity when the screed bar 111 is leveling the sand contained in the sand mold structure 103. The second screed congruent end 132 is a congruent end of the prism structure of the screed bar 111. The second screed congruent end 132 is the congruent end of the screed bar 111 that is distal from the first screed congruent end 131. The face formed by the second screed congruent end 132 is aligned to be parallel to the force of gravity when the screed bar 111 is leveling the sand contained in the sand mold structure 103.

The screed superior lateral face 133 is a lateral face of the prism structure of the screed bar 111. The screed superior lateral face 133 is the lateral face of the prism structure of the screed bar 111 that is distal from the sand mold structure 103. The face formed by the screed superior lateral face 133 is aligned in a direction that is perpendicular to the force of gravity. The screed superior lateral face 133 forms the superior surface of the screed bar 111.

The screed inferior lateral face 134 is a lateral face of the prism structure of the screed bar 111. The screed inferior lateral face 134 is the lateral face of the prism structure of the screed bar 111 that is proximal to the sand mold structure 103. The face formed by the screed inferior lateral face 134 is aligned in a direction that is perpendicular to the force of gravity. The screed inferior lateral face 134 forms the inferior surface of the screed bar 111. The screed inferior lateral face 134 is the lateral face of the prism structure of the screed bar 111 that is distal from the screed superior lateral face 133. The rake 112 attaches to the screed inferior lateral face 134 of the screed bar 111.

The screed bar 111 further comprises a first wheel structure 171 and a second wheel structure 172. The first wheel structure 171 is a mechanical structure. The first wheel structure 171 is a rolling structure. The first wheel structure 171 attaches to the first screed congruent end 131 of the screed bar 111. The first wheel structure 171 mounts on the individual rail superior lateral face 143 of a first individual rail track 140 selected from the plurality of rail tracks 102 such that the first wheel structure 171 rolls on the first selected individual rail track 140.

The second wheel structure 172 is a mechanical structure. The second wheel structure 172 is a rolling structure. The second wheel structure 172 attaches to the second screed congruent end 132 of the screed bar 111. The second wheel structure 172 mounts on the individual rail superior lateral face 143 of a second individual rail track 140 selected from the plurality of rail tracks 102 such that the second wheel structure 172 rolls on the second selected individual rail track 140.

The rake 112 is drawn through the sand contained in the sand mold structure 103 to align and smooth the remaining sand. The rake 112 is a tool used to align and control bulk solid materials. The rake 112 attaches to the screed inferior lateral face 134 of the screed bar 111. The screed bar 111 draws a comb structure formed by the rake 112 through the sand mold structure 103. The rake 112 is defined elsewhere in this disclosure.

The plurality of rail tracks 102 forms a pedestal structure. The plurality of rail tracks 102 elevates the screed structure 101 above the sand mold structure 103. The plurality of rail tracks 102 forms the load path that transfers the load of the screed structure 101 to a supporting surface. The screed structure 101 mounts on the plurality of rail tracks 102 such that the screed structure 101 straddles the sand mold structure 103. The plurality of rail tracks 102 forms the track that the screed structure 101 rolls over while leveling the sand contained in the sand mold structure 103. The plurality of rail tracks 102 comprises a collection of individual rail tracks 140. Each individual rail track 140 selected from the plurality of rail tracks 102 is identical.

Each individual rail track 140 selected from the plurality of rail tracks 102 is a prism shaped structure. Each individual rail track 140 has a rectangular prism shape. Each individual rail track 140 is a rigid structure. Each individual rail track 140 selected from the plurality of rail tracks 102 forms a pedestal structure that transfers a portion of the load of the screed structure 101 to a supporting surface. Any first individual rail track 140 selected from the plurality of rail tracks 102 is identical to any second individual rail track 140 selected from the plurality of rail tracks 102. Each individual rail track 140 forms a track that supports and guides the screed structure 101 as the screed structure 101 rolls over the plurality of rail tracks 102.

Each selected individual rail track 140 comprises a first individual rail congruent end 141, a second individual rail congruent end 142, an individual rail superior lateral face 143, an individual rail inferior lateral face 144, an individual rail interior lateral face 145, and an individual rail exterior lateral face 146.

The first individual rail congruent end 141 is a congruent end of the prism structure of the individual rail track 140. The face formed by the first individual rail congruent end 141 is aligned in a direction that is parallel to the force of gravity. The second individual rail congruent end 142 is a congruent end of the prism structure of the individual rail track 140. The second individual rail congruent end 142 is the congruent end of the individual rail track 140 that is distal from the first individual rail congruent end 141. The face formed by the second individual rail congruent end 142 is aligned in a direction that is parallel to the force of gravity.

The individual rail superior lateral face 143 is a lateral face of the prism structure of the individual rail track 140. The individual rail superior lateral face 143 forms the superior surface of the individual rail track 140. The individual rail superior lateral face 143 forms the surface over which the individual rail superior lateral face 143 on which the screed structure 101 rolls.

The individual rail inferior lateral face 144 is a lateral face of the prism structure of the individual rail track 140. The individual rail inferior lateral face 144 forms the inferior surface of the individual rail track 140. The plurality of elevating stanchions 147 attach to the individual rail inferior lateral face 144 of the individual rail track 140. The load of the individual rail track 140 transfers to the plurality of elevating stanchions 147 through the individual rail inferior lateral face 144. The plurality of elevating stanchions 147 elevates the individual rail inferior lateral face 144 of the individual rail track 140 above the supporting surface.

The individual rail interior lateral face 145 is a lateral face of the prism structure of the individual rail track 140. The individual rail interior lateral face 145 forms the lateral face of the individual rail track 140 that is proximal to the sand mold structure 103.

The individual rail exterior lateral face 146 is a lateral face of the prism structure of the individual rail track 140. The individual rail exterior lateral face 146 is the lateral face of the individual rail track 140 that is distal from the individual rail interior lateral face 145.

Each selected individual rail track 140 further comprises a plurality of elevating stanchions 147. Each individual elevating stanchion 151 selected from the plurality of elevating stanchions 147 comprises a footer 161, a leveling bolt 162, a superior nut 163, and an inferior nut 164.

Each individual elevating stanchion 151 selected from the plurality of elevating stanchions 147 is a load bearing structure. Each individual elevating stanchion 151 selected from the plurality of elevating stanchions 147 is identical. Each individual elevating stanchion 151 attaches to the individual rail inferior lateral face 144 of the individual rail track 140. Each individual elevating stanchion 151 transfers a portion the load of the individual rail track 140 to the supporting surface. Each individual elevating stanchion 151 elevates the individual rail track 140 above the supporting surface such that the individual rail track 140 elevates the screed structure 101 above the sand contained in the sand mold structure 103. Each individual elevating stanchion 151 is an adjustable structure\. Each individual elevating stanchion 151 allows for the adjustment of the elevation of the individual rail track 140 above the supporting surface.

The footer 161 is a disk shaped structure. The footer 161 forms the inferior structure of the individual elevating stanchion 151. The footer 161 rests on the supporting surface.

The leveling bolt 162 is a stanchion. The leveling bolt 162 is a prism shaped structure. A congruent end of the leveling bolt 162 attaches to the footer 161 such that the leveling bolt 162 projects perpendicularly away from the footer 161 in the superior direction. The leveling bolt 162 forms the load path that transfers the load of the individual rail track 140 to the footer 161. The leveling bolt 162 is formed as a bolt. The leveling bolt 162 inserts through the individual rail inferior lateral face 144 and the individual rail superior lateral face 143 of the individual rail track 140.

The inferior nut 164 is a nut. The inferior nut 164 screws onto the leveling bolt 162. The inferior nut 164 is positioned on the leveling bolt 162 in a position that is inferior to the individual rail track 140. The inferior nut 164 forms the structure that supports the individual rail track 140 above the supporting surface. The elevation of the individual rail track 140 above the supporting surface is adjusted by adjusting the position of the inferior nut 164 relative to the leveling bolt 162.

The superior nut 163 is a nut. The superior nut 163 screws onto the leveling bolt 162. The superior nut 163 ensures that the individual rail track 140 will not climb off the individual elevating stanchion 151 during the use of the invention 100.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Bolt: As used in this disclosure, a bolt is a cylindrical shaft that is formed with an exterior screw thread. A bolt is defined with an outer dimension.

Bolt Hole: As used in this disclosure, a bolt hole is a prism-shaped disk that is formed with a cylindrical negative space that allows a shaft to be inserted through the faces of the disk. A bolt hole is further defined with an inner diameter. See Recess Bulk Solid: As used in this disclosure, a bulk solid is a material that is formed from an accumulation of discrete particles. While the discrete particles of the bulk solid are solid materials, in aggregate the physical performance of bulk solid will exhibit fluid characteristics such as flow or taking the shape of a container.

Cant: As used in this disclosure, a cant is an angular deviation from one or more reference lines (or planes) such as a vertical line (or plane) or a horizontal line (or plane).

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Comb: As used in this disclosure, a comb is a toothed device that is used for arranging loose objects such as bulk solids or hair. The comb comprises a shaft from which project a plurality of teeth. Each of the plurality of teeth is a rod that projects away from the shaft. The loose objects pass between the diastema between each pair of adjacent teeth selected from the plurality of teeth.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Correspond: As used in this disclosure, the term correspond is used as a comparison between two or more objects wherein one or more properties shared by the two or more objects match, agree, or align within acceptable manufacturing tolerances.

Diastema: As used in this disclosure, a diastema is the space between two teeth.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Elevation: As used in this disclosure, elevation refers to the span of the distance in the superior direction between a specified horizontal surface and a reference horizontal surface. Unless the context of the disclosure suggest otherwise, the specified horizontal surface is the supporting surface the potential embodiment of the disclosure rests on. The infinitive form of elevation is to elevate.

Exterior: As used in this disclosure, the exterior is used as a relational term that implies that an object is not contained within the boundary of a structure or a space.

Exterior Screw Thread: An exterior screw thread is a ridge wrapped around the outer surface of a tube in the form of a helical structure that is used to convert rotational movement into linear movement.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Helix: As used in this disclosure, a helix is the three-dimensional structure that would be formed by a wire that is wound uniformly around the surface of a cylinder or a cone. If the wire is wrapped around a cylinder the helix is called a cylindrical helix. If the wire is wrapped around a cone, the helix is called a conical helix. A synonym for conical helix would be a volute.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inferior: As used in this disclosure, the term inferior refers to a directional reference that is parallel to and in the same direction as the force of gravity when an object is positioned or used normally.

Interior: As used in this disclosure, the interior is used as a relational term that implies that an object is contained within the boundary of a structure or a space.

Interior Screw Thread: An interior screw thread is a groove that is formed around the inner surface of a tube in the form of a helical structure that is used to convert rotational movement into linear movement.

Level: As used in this disclosure, the verb to level means to modify the position of a surface relative to the force of gravity such that the surface forms a plane that is aligned: a) parallel to the horizontal direction; and, b) perpendicular to the vertical direction.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Negative Space: As used in this disclosure, negative space is a method of defining an object through the use of open or empty space as the definition of the object itself, or, through the use of open or empty space to describe the boundaries of an object.

Nut: As used in this disclosure, a nut is a first object that is formed with a cylindrical negative space that further comprises an interior screw thread such that a second object with a matching exterior screw thread can screwed into the first object forming a threaded connection. A nut is further defined with an inner dimension.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent end of the prism structure that forms the pan; and, b) a lateral face of the prism structure that forms the pan. A semi-enclosed pan refers to a pan wherein the closed end of prism structure of the pan and/or a portion of the closed lateral faces of the pan are open.

Pedestal: As used in this disclosure, a pedestal is an intermediary load bearing structure that forms a load path between a supporting surface and an object, structure, or load.

Perimeter: As used in this disclosure, a perimeter is one or more curved or straight lines that bounds an enclosed area on a plane or surface. The perimeter of a circle is commonly referred to as a circumference.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Rail: As used in this disclosure, a rail is a continuous structure that forms a path that is used to guide the motion of an object.

Rake: As used in this disclosure, a rake is a toothed structure used to collect and organize bulk solids. A rake comprises a comb structure as a working element and a shaft as a handle.

Reach: As used in this disclosure, reach refers to a span of distance between any two objects.

Screw: As used in this disclosure, a screw is a cylindrical, or tapered cylindrical, structure that is formed with an exterior screw thread. A screw is used to attach a first object to a second object. Screws are well known and documented in the mechanical arts.

Spar: As used in this disclosure, a spar is a horizontally oriented beam that forms the superior element of a structure.

Stanchion: As used in this disclosure, a stanchion refers to a vertically oriented prism-shaped pole, post, or support.

Straddle: As used in this disclosure, a first object is said to straddle a second object when: a) the first object is formed with a pedestal and an elevated structure; b) the pedestal is formed with a plurality of pedestal structures; c) the plurality of pedestal structures forms a reach; d) the reach is sized to receive the second object fits between the plurality of pedestal structures; and, e) the plurality of pedestal structures forms a plurality of load paths that elevate the elevated structure over the second object.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load of the object is transferred. This disclosure assumes that an object placed on the supporting surface is in an orientation that is appropriate for the normal or anticipated use of the object.

Screw: As used in this disclosure, to screw is a verb meaning: 1) to fasten or unfasten (unscrew) a threaded connection; or 2) to attach a helical structure to a solid structure.

Threaded Connection: As used in this disclosure, a threaded connection is a type of fastener that is used to join a first cylindrical object and a second cylindrical object together. The first cylindrical object is fitted with a first fitting selected from an interior screw thread or an exterior screw thread. The second cylindrical object is fitted with the remaining screw thread. The cylindrical object fitted with the exterior screw thread is placed into the remaining cylindrical object such that: 1) the interior screw thread and the exterior screw thread interconnect; and, 2) when the cylindrical object fitted with the exterior screw thread is rotated the rotational motion is converted into linear motion that moves the cylindrical object fitted with the exterior screw thread either into or out of the remaining cylindrical object. The direction of linear motion is determined by the direction of rotation.

Tool: As used in this disclosure, a tool is a device, an apparatus, or an instrument that is used to carry out an activity, operation, or procedure. A tool generally comprises a working element and a handle.

Track: As used in this disclosure, a track is a physical structural relationship between a first object and a second object that serves a purpose selected from the group consisting of: 1) fastening the second object to the first object; 2) controlling the path of motion of the first object relative to the second object in at least one dimension and in a maximum of two dimensions; or, 3) a combination of the first two elements of this group.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

Wheel: As used in this disclosure, a wheel is a circular object that revolves around an axle or an axis and is fixed below an object to enable it to move easily over the ground. For the purpose of this disclosure, it is assumed that a wheel can only revolve in a forward and a backward direction. Wheels are often further defined with a rim and spokes. Spokes are also commonly referred to as a wheel disk.

Working Element: As used in this disclosure, the working element of a tool is the physical element on the tool that performs the actual activity, operation, or procedure the tool is designed to perform. For example, the cutting edge of a blade is the working element of a knife.

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A rolling leveler for sand bed for stone pavers comprising a screed structure and a plurality of rail tracks;

wherein the screed structure rolls along plurality of rail tracks;

wherein the rolling leveler for sand bed for stone pavers is configured for use with sand;

wherein the rolling leveler for sand bed for stone pavers levels sand after the sand has been placed into a sand mold;

wherein the plurality of rail tracks comprises a collection of individual rail tracks;

wherein each selected individual rail track further comprises a plurality of elevating stanchions;

wherein each selected individual rail track comprises a first individual rail congruent end, a second individual rail congruent end, an individual rail superior lateral face, an individual rail inferior lateral face, an individual rail interior lateral face, and an individual rail exterior lateral face;

wherein the plurality of elevating stanchions attach to the individual rail inferior lateral face of the individual rail track;

wherein each individual elevating stanchion selected from the plurality of elevating stanchions further comprises a footer, a leveling bolt, an inferior nut, and a superior nut;

wherein the footer forms the inferior structure of the individual elevating stanchion;

wherein the footer rests on the supporting surface surrounding the sand mold;

wherein the leveling bolt attaches to the footer such that the leveling bolt projects perpendicularly away from the footer;

wherein the leveling bolt forms a load path that transfers the load of the individual rail track to the footer;

wherein the leveling bolt inserts through the individual rail inferior lateral face and the individual rail superior lateral face of the individual rail track;

wherein the inferior nut screws onto the leveling bolt;

wherein the inferior nut is positioned on the leveling bolt in a position that is inferior to the individual rail track;

wherein the inferior nut forms the structure that supports the individual rail track above the supporting surface;

wherein an elevation of the individual rail track above the supporting surface is adjusted by adjusting the position of the inferior nut relative to the leveling bolt;

wherein the superior nut screws onto the leveling bolt, and ensures that the individual rail track will not climb off the individual elevating stanchion during use.

2. The rolling leveler for sand bed for stone pavers according to claim 1 wherein the plurality of rail tracks elevates the screed structure above the sand contained in the sand mold;

wherein the elevation of the screed structure above the sand mold is adjustable;

wherein the screed structure rolls along the plurality of rail tracks to level the sand contained in the sand mold.

3. The rolling leveler for sand bed for stone pavers according to claim 2 wherein the screed structure attaches to the plurality of rail tracks;

wherein the elevation of the screed structure is adjusted by adjusting the plurality of rail tracks;

wherein the elevation of the plurality of rail tracks elevates the screed structure such that the screed structure straddles the sand contained in the sand mold wherein the screed structure rolls along a track formed by the plurality of rail tracks.

4. The rolling leveler for sand bed for stone pavers according to claim 3 wherein the plurality of rail tracks elevates the screed structure above the sand mold;

wherein the plurality of rail tracks forms the load path that transfers the load of the screed structure to a supporting surface;

wherein the screed structure mounts on the plurality of rail tracks such that the screed structure straddles the sand mold;

wherein the plurality of rail tracks forms the track that the screed structure rolls over while leveling the sand contained in the sand mold.

5. The rolling leveler for sand bed for stone pavers according to claim 4 wherein each individual rail track selected from the plurality of rail tracks is a prism shaped structure;

wherein each individual rail track has a rectangular prism shape;

wherein each individual rail track is a rigid structure;

wherein each individual rail track selected from the plurality of rail tracks forms a pedestal structure that transfers a portion of the load of the screed structure to a supporting surface;

wherein any first individual rail track selected from the plurality of rail tracks is identical to any second individual rail track selected from the plurality of rail tracks.

6. The rolling leveler for sand bed for stone pavers according to claim 5 wherein the screed structure comprises a screed bar and a rake;

wherein the rake attaches to the screed bar.

7. The rolling leveler for sand bed for stone pavers according to claim 6 wherein the screed bar is a rigid structure;

wherein the screed bar attaches to the plurality of rail tracks such that the screed bar moves relative to the plurality of rail tracks;

wherein the screed bar is a rolling structure;

wherein the screed bar rolls along a track formed by the plurality of rail tracks;

wherein the screed bar straddles the sand contained in the sand mold;

wherein the plurality of rail tracks adjusts the elevation of the screed bar relative to the sand mold;

wherein the screed bar straddles the sand contained in the sand mold;

wherein the screed bar comprises a first screed congruent end, a second screed congruent end, a screed superior lateral face, and a screed inferior lateral face;

wherein the first screed congruent end is a congruent end of the prism structure of the screed bar;

wherein the face formed by the first screed congruent end is aligned to be parallel to the force of gravity when the screed bar is leveling the sand contained in the sand mold;

wherein the second screed congruent end is a congruent end of the prism structure of the screed bar;

wherein the second screed congruent end is the congruent end of the screed bar that is distal from the first screed congruent end;

wherein the face formed by the second screed congruent end is aligned to be parallel to the force of gravity when the screed bar is leveling the sand contained in the sand mold;

wherein the screed superior lateral face is a lateral face of the prism structure of the screed bar;

wherein the screed superior lateral face is the lateral face of the prism structure of the screed bar that is distal from the sand mold;

wherein the face formed by the screed superior lateral face is aligned in a direction that is perpendicular to the force of gravity;

wherein the screed superior lateral face forms the superior surface of the screed bar;

wherein the screed inferior lateral face is a lateral face of the prism structure of the screed bar;

wherein the screed inferior lateral face is the lateral face of the prism structure of the screed bar that is proximal to the sand mold;

wherein the face formed by the screed inferior lateral face is aligned in a direction that is perpendicular to the force of gravity;

wherein the screed inferior lateral face forms the inferior surface of the screed bar;

wherein the screed inferior lateral face is the lateral face of the prism structure of the screed bar that is distal from the screed superior lateral face.

8. The rolling leveler for sand bed for stone pavers according to claim 7 wherein the rake attaches to the screed inferior lateral face of the screed bar;

wherein the rake is drawn through the sand contained in the sand mold.

9. The rolling leveler for sand bed for stone pavers according to claim 8 wherein the screed bar further comprises a first wheel structure and a second wheel structure;

wherein the first wheel structure is a mechanical structure;

wherein the first wheel structure is a rolling structure;

wherein the first wheel structure attaches to the first screed congruent end of the screed bar;

wherein the first wheel structure mounts on the individual rail superior lateral face of a first individual rail track selected from the plurality of rail tracks such that the first wheel structure rolls on the first selected individual rail track;

wherein the second wheel structure is a mechanical structure;

wherein the second wheel structure is a rolling structure;

wherein the second wheel structure attaches to the second screed congruent end of the screed bar;

wherein the second wheel structure mounts on the individual rail superior lateral face of a second individual rail track selected from the plurality of rail tracks such that the second wheel structure rolls on the second selected individual rail track.

10. The rolling leveler for sand bed for stone pavers according to claim 9 wherein the first individual rail congruent end is a congruent end of the prism structure of the individual rail track;

wherein the face formed by the first individual rail congruent end is aligned in a direction that is parallel to the force of gravity;

wherein the second individual rail congruent end is a congruent end of the prism structure of the individual rail track;

wherein the second individual rail congruent end is the congruent end of the individual rail track that is distal from the first individual rail congruent end;

wherein the face formed by the second individual rail congruent end is aligned in a direction that is parallel to the force of gravity;

wherein the individual rail superior lateral face is a lateral face of the prism structure of the individual rail track;

wherein the individual rail superior lateral face forms the superior surface of the individual rail track;

wherein the individual rail superior lateral face forms the surface over which the individual rail superior lateral face on which the screed structure rolls;

wherein the individual rail inferior lateral face is a lateral face of the prism structure of the individual rail track;

wherein the individual rail inferior lateral face forms the inferior surface of the individual rail track;

wherein the individual rail interior lateral face is a lateral face of the prism structure of the individual rail track;

wherein the individual rail interior lateral face forms the lateral face of the individual rail track that is proximal to the sand mold;

wherein the individual rail exterior lateral face is a lateral face of the prism structure of the individual rail track;

wherein the individual rail exterior lateral face is the lateral face of the individual rail track that is distal from the individual rail interior lateral face.

11. The rolling leveler for sand bed for stone pavers according to claim 10 wherein each individual elevating stanchion selected from the plurality of elevating stanchions is a load bearing structure;

wherein each individual elevating stanchion selected from the plurality of elevating stanchions is identical;

wherein each individual elevating stanchion attaches to the individual rail inferior lateral face of the individual rail track;

wherein each individual elevating stanchion transfers a portion the load of the individual rail track to the supporting surface;

wherein each individual elevating stanchion elevates the individual rail track above the supporting surface such that the individual rail track elevates the screed structure above the sand contained in the sand mold;

wherein each individual elevating stanchion is an adjustable structure;

wherein each individual elevating stanchion allows for the adjustment of the elevation of the individual rail track above the supporting surface.

* * * * *